US010563278B2

(12) United States Patent
Okushiro et al.

(10) Patent No.: US 10,563,278 B2
(45) Date of Patent: Feb. 18, 2020

(54) RAIL MANUFACTURING METHOD AND MANUFACTURING EQUIPMENT

(71) Applicant: JFE STEEL CORPORATION, Tokyo (JP)

(72) Inventors: Kenji Okushiro, Tokyo (JP); Hiroyuki Fukuda, Tokyo (JP); Hideo Kijima, Tokyo (JP); Moriyasu Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/180,508

(22) Filed: Nov. 5, 2018

(65) Prior Publication Data

US 2019/0106762 A1 Apr. 11, 2019

Related U.S. Application Data

(62) Division of application No. 14/770,664, filed as application No. PCT/JP2014/058275 on Mar. 25, 2014, now Pat. No. 10,214,795.

(30) Foreign Application Priority Data

Mar. 28, 2013 (JP) ..... 2013-068745
Sep. 27, 2013 (JP) ..... 2013-201675

(51) Int. Cl.
*C21D 9/04* (2006.01)
*B21B 1/085* (2006.01)
(Continued)

(52) U.S. Cl.
CPC ..... *C21D 9/04* (2013.01); *B21B 1/085* (2013.01); *B21B 45/02* (2013.01); *C21D 1/18* (2013.01);
(Continued)

(58) Field of Classification Search
CPC ..... C21D 9/04; C21D 1/56
See application file for complete search history.

(56) References Cited

U.S. PATENT DOCUMENTS 7,416,622 B2 8/2008 Kuppers et al.
8,241,442 B2 8/2012 Bramfitt et al.
(Continued)

FOREIGN PATENT DOCUMENTS

CA 2222281 A1 10/1997
CN 1561399 A 1/2005
(Continued)

OTHER PUBLICATIONS

Jun. 17, 2014 International Search Report issued in International Patent Application No. PCT/JP2014/058275.
(Continued)

*Primary Examiner* — Scott R Kastler
(74) *Attorney, Agent, or Firm* — Oliff PLC

(57) ABSTRACT

Rail-manufacturing equipment that performs forced cooling on at least a head of a hot rail hot-rolled at or heated to the austenite region temperature or higher. The rail-manufacturing equipment includes a head-cooling header configured to jet a cooling medium toward the head of the rail, a head thermometer configured to measure surface temperature of the head of the rail, and a controller configured to adjust jet of the cooling medium from the head-cooling header. The controller includes a temperature-monitoring unit configured to monitor measurement results by the head thermometer during the forced cooling, and a cooling-rate controller.

5 Claims, 7 Drawing Sheets

(51) Int. Cl.

| | |
|---|---|
| ***B21B 45/02*** | (2006.01) |
| ***C21D 1/18*** | (2006.01) |
| ***C22C 38/00*** | (2006.01) |
| ***C21D 1/62*** | (2006.01) |
| ***C21D 1/667*** | (2006.01) |
| ***C22C 38/20*** | (2006.01) |
| ***C22C 38/26*** | (2006.01) |
| ***C22C 38/24*** | (2006.01) |
| ***C22C 38/22*** | (2006.01) |
| ***C22C 38/40*** | (2006.01) |
| ***C22C 38/18*** | (2006.01) |
| ***C22C 38/04*** | (2006.01) |
| ***C22C 38/02*** | (2006.01) |
| ***C21D 1/56*** | (2006.01) |
| ***C21D 6/00*** | (2006.01) |
| *C22C 38/50* | (2006.01) |

(52) U.S. Cl.

CPC ..... *C21D 1/56* (2013.01); *C21D 1/62* (2013.01); *C21D 1/667* (2013.01); *C21D 6/00* (2013.01); *C22C 38/00* (2013.01); *C22C 38/02* (2013.01); *C22C 38/04* (2013.01); *C22C 38/18* (2013.01); *C22C 38/20* (2013.01); *C22C 38/22* (2013.01); *C22C 38/24* (2013.01); *C22C 38/26* (2013.01); *C22C 38/40* (2013.01); *B21B 2045/0221* (2013.01); *C21D 2211/009* (2013.01); *C22C 38/50* (2013.01)

(56) References Cited

U.S. PATENT DOCUMENTS

| | | | | |
|---|---|---|---|---|
| 8,353,443 | B2 | 1/2013 | Sugiyama et al. | |
| 8,715,565 | B2 | 5/2014 | Sugiyama et al. | |
| 8,980,019 | B2 | 3/2015 | Ueda et al. | |
| 9,255,304 | B2 | 2/2016 | Sugiyama et al. | |
| 2004/0231763 | A1 | 11/2004 | Kuppers et al. | |
| 2010/0307646 | A1 | 12/2010 | Sugiyama et al. | |
| 2012/0012296 | A1* | 1/2012 | Sugiyama ..... | B23K 11/04 165/200 |
| 2014/0208780 | A1 | 7/2014 | Sugiyama et al. | |

FOREIGN PATENT DOCUMENTS

| | | | |
|---|---|---|---|
| CN | 101959626 | A | 1/2011 |
| CN | 102361725 | A | 2/2012 |
| JP | S62-120429 | A | 6/1987 |
| JP | S63-134632 | A | 6/1988 |
| JP | H09-316598 | A | 12/1997 |
| JP | 2002-105538 | A | 4/2002 |
| JP | 2005-504174 | A | 2/2005 |
| JP | 2005-171327 | A | 6/2005 |
| JP | 3731934 | B2 | 1/2006 |
| JP | 4938158 | B2 | 5/2012 |
| WO | 03/028912 | A2 | 4/2003 |
| WO | 2011/155481 | A1 | 12/2011 |

OTHER PUBLICATIONS

Mar. 14, 2016 Extended Search Report issued in European Patent Application No. 14773268.9.

May 31, 2016 Office Action issued in Chinese Patent Application No. 201480017861.9.

Dec. 20, 2017 Office Action issued in U.S. Appl. No. 14/770,664.

May 4, 2018 Office Action issued in U.S. Appl. No. 14/770,664.

* cited by examiner

RAIL MANUFACTURING METHOD AND MANUFACTURING EQUIPMENT

This application is a Divisional of application Ser. No. 14/770,664, now U.S. Pat. No. 10,214,795, filed Aug. 26, 2015, which is a national stage of PCT/JP2014/058275, filed Mar. 25, 2014, which claims priority to Japanese Application No. 2013-201675, filed Sep. 27, 2013, and Japanese Application No. 2013-068745, filed Mar. 28, 2013. The entire contents of the prior applications are hereby incorporated by reference herein in their entireties.

FIELD

The present invention relates to a rail-manufacturing method in which forced cooling is performed on at least a head of a hot rail at a temperature that is equal to or higher than an austenite region temperature, and a manufacturing equipment therefor.

BACKGROUND

In general, in a process of producing a rail for railroad, a steel material is heated and, after hot-rolled into a certain shape at the austenite region temperature or higher or after reheated to the austenite region temperature or higher, the resulting steel is forcedly cooled to secure a desired quality such as hardness required for a rail head. This forced cooling is performed by jetting a cooling medium (air, water, mist, or the like) to a rail until the temperature of the rail head reaches 350° C. to 450° C. while controlling the temperature history, whereby the rail head can have a fine pearlite structure and thus the rail can have a high hardness with improved wear resistance and toughness. For example, under a severe use environment for a rail, like railroad transportation in a mine of natural resources such as coal, in which the loading weight is heavier than that of a passenger car, for example, the rail severely wears, and the life-span for using the rail is short. Accordingly, wear resistance and toughness thereof are particularly required to be improved.

Bainite has low wear resistance, and martensite has low toughness. Accordingly, to achieve high wear resistance and high toughness simultaneously, bainite transformation and martensite transformation of the rail head that occur during the above-described forced cooling are required to be prevented for the rail head in order to have a pearlite structure stably. In addition, because pearlite has higher wear resistance and higher toughness with smaller lamellar spacing, it is important to achieve finer lamellar spacing.

The transformation to bainite or martensite during the forced cooling is affected by a cooling rate during the forced cooling. In particular, if the cooling rate is 3° C./s or higher all the time during the forced cooling, it is highly possible that the transformation to bainite or martensite occurs. As a technique to solve this type of problem, Patent Literature 1, for example, discloses a technique in which the rate of cooling a head surface until pearlite transformation starts is set to 1° C./s to 10° C./s, and the rate of cooling the head surface until the pearlite transformation in a region at 20 millimeters or deeper from the surface ends is set to 2° C./s to 20° C./s. Patent Literature 2 discloses a technique of suppressing tempering of pearlite. This suppression is accomplished by performing first forced cooling from a temperature range of 750° C. or higher down to 600° C. to 450° C. at a cooling rate of 4° C./s to 15° C./s and then, after temporary stop of the forced cooling to raise the temperature thereby ending pearlite transformation, performing second forced cooling down to 400° C. at a cooling rate of 0.5° C./s to 2.0° C./s.

CITATION LIST

Patent Literature

Patent Literature 1: Japanese Patent No. 3731934
Patent Literature 2: Japanese Patent No. 4938158

SUMMARY

Technical Problem

In the above-described technique of Patent Literature 1, the cooling rate after the start of the transformation in a surface layer of the rail head is set to 2° C./s or higher. However, according to investigations by the inventors of the present invention, the surface layer does not completely transform into pearlite at a cooling rate of 2° C./s or higher and part thereof transforms into bainite, resulting in a problem of reduced wear resistance.

In the technique of Patent Literature 2, the temporary stop of the forced cooling increases the time required to cool down to the target cooling-stop temperature. In addition, the stop of the forced cooling significantly increases the surface temperature of the rail head, so that the cooling rate in a central portion of the rail head is reduced, resulting in a problem in that sufficient hardness cannot be obtained in the central portion.

Furthermore, in the technique of Patent Literature 2, the first forced cooling is performed down to 600° C. to 450° C. at a cooling rate of 4° C./s to 15° C./s. However, according to the investigations by the inventors of the present invention, at the cooling rate of 4° C./s to 15° C./s, part of the surface layer sometimes transforms into martensite or transforms into bainite depending on components of the rail. When part of the surface layer transforms into martensite, the hardness increases, but the ductility is lost. When part of the surface layer transforms into bainite, the hardness and the wear resistance decrease.

In the above-described technique of Patent Literature 2, the second forced cooling is performed at a cooling rate of 0.5° C./s to 2.0° C./s. However, according to the investigations by the inventors of the present invention, at a cooling rate of 0.5° C./s to 2.0° C./s, pearlite may be tempered depending on components of the rail, resulting in reduced hardness.

The present invention has been made to solve the above-described problems, and aims at providing a rail manufacturing method and a manufacturing equipment that enable the whole of the head of a rail from the head surface to the central portion to have high hardness with the surface layer thereof having a pearlite structure with high hardness without increasing the cooling time.

Solution to Problem

To solve the above-described problem and achieve the object, a rail manufacturing method according to the present invention performs forced cooling on at least a head of the rail that is hot after hot-rolled at an austenite region temperature or higher or after heated to the austenite region temperature or higher, and includes: performing the forced cooling for 10 seconds from start of the forced cooling so that a cooling rate at a surface of the head becomes 1° C./s to 20° C./s; performing the forced cooling during a period after a lapse of 10 seconds from the start of the forced cooling until heat generation during transformation begins at the surface of the head so that the cooling rate at the surface of the head becomes 1° C./s to 5° C./s; performing the forced cooling during transformation from beginning to end of the heat generation during transformation so that the cooling rate at the surface of the head becomes lower than 1° C./s or a temperature-rising rate becomes 5° C./s or lower; and performing the forced cooling during a period after the end of the heat generation during transformation until temperature at the surface of the head becomes 450° C. or lower so that the cooling rate at the surface of the head becomes 1° C./s to 20° C./s.

It is preferable that the forced cooling is performed with a first cooling device and a second cooling device, the forced cooling is performed with the first cooling device during a period after the end of the heat generation during transformation from the start of the forced cooling until temperature inside the head of the rail becomes 550° C. to 650° C., and subsequently the forced cooling is performed with the second cooling device until the temperature at the surface of the head becomes 450° C. or lower so that the cooling rate at the surface of the head of the rail becomes 2° C./s to 20° C./s.

It is preferable that the forced cooling with the second cooling device is performed in a period until the rail forcedly cooled in the first cooling device is conveyed to a cooling bed.

It is preferable that the first cooling device forcedly cools the rail with air or mist, and the second cooling device forcedly cools the rail with mist or water.

It is preferable that the second cooling device conveys the rail in one direction to forcedly cool the rail.

To solve the above-described problem and achieve the object, a rail-manufacturing equipment according to one aspect of the present invention performs forced cooling on at least a head of a rail that is hot after hot-rolled at an austenite region temperature or higher or after heated to the austenite region temperature or higher, and includes: a head-cooling header configured to jet a cooling medium toward the head of the rail; a head thermometer configured to measure surface temperature of the head of the rail; and a controller configured to adjust jet of the cooling medium from the head-cooling header. The controller includes a temperature-monitoring unit configured to monitor measurement results by the head thermometer during the forced cooling, and the controller further includes a cooling-rate controller configured to: adjust the jet of the cooling medium from the head-cooling header for 10 seconds from start of the forced cooling so that a cooling rate at a surface of the head becomes 1° C./s to 20° C./s; determine beginning and end of heat generation during transformation based on a history of the measurement results monitored by the temperature-monitoring unit, and adjust the jet of the cooling medium from the head-cooling header during a period from the beginning to the end of the heat generation during transformation so that the cooling rate at the surface of the head becomes lower than 1° C./s or a temperature-rising rate becomes 5° C./s or lower; and adjust the jet of the cooling medium from the head-cooling header during a period after the end of the heat generation during transformation until temperature at the surface of the head becomes 450° C. or lower so that the cooling rate at the surface of the head becomes 1° C./s to 20° C./s.

To solve the above-described problem and achieve the object, a rail-manufacturing equipment according to another aspect of the present invention performs forced cooling on at least a head of a rail that is hot after hot-rolled at an austenite region temperature or higher or after heated to the austenite region temperature or higher, and includes: a first cooling device including a first head-cooling header configured to jet a cooling medium toward the head of the rail and a first head thermometer configured to measure surface temperature of the head of the rail; a second cooling device including a second head-cooling header configured to jet the cooling medium toward the head of the rail and a second head thermometer configured to measure surface temperature of the head of the rail; and a controller configured to adjust jet of the cooling medium from the first head-cooling header and the second head-cooling header. The controller includes a temperature-monitoring unit configured to monitor measurement results by the first head thermometer and the second head thermometer during the forced cooling, and the controller further includes a cooling-rate controller configured to: adjust the jet of the cooling medium from the first head-cooling header for 10 seconds from start of the forced cooling so that a cooling rate at a surface of the head becomes 1° C./s to 20° C./s; determine beginning and end of heat generation during transformation based on a history of the measurement results by the first head thermometer monitored by the temperature-monitoring unit, and adjust the jet of the cooling medium from the first head-cooling header during a period from the beginning to the end of the heat generation during transformation so that the cooling rate at the surface of the head becomes lower than 1° C./s or a temperature-rising rate becomes 5° C./s or lower; adjust the jet of the cooling medium from the first head-cooling header during a period after the end of the heat generation during transformation until temperature inside the head of the rail becomes 550° C. to 650° C. so that the cooling rate at the surface of the head becomes 1° C./s to 20° C./s; instruct the rail to be conveyed to the second cooling device after the temperature inside the head of the rail becomes 550° C. to 650° C.; and adjust the jet of the cooling medium from the second cooling header during a period until temperature at the surface of the head of the rail becomes 450° C. or lower toward the rail forcedly cooled in the first cooling device so that the cooling rate at the surface of the head of the rail becomes 2° C./s to 20° C./s.

It is preferable that the forced cooling with the second cooling device is performed in a period until the rail forcedly cooled in the first cooling device is conveyed to a cooling bed.

It is preferable that the cooling medium is air or mist in the first cooling device, and the cooling medium is mist or water in the second cooling device.

Advantageous Effects of Invention

According to the present invention, the surface temperature of a head can be retained or raised during transformation of the surface layer of the head without stopping forced cooling of the head, enabling the whole of the head of a rail from the head surface to the central portion to have high hardness.

DESCRIPTION OF EMBODIMENTS

Configurations of rail-manufacturing equipment according to first and second embodiments of the present invention and operations thereof are described hereinafter with reference to the drawings.

[First Embodiment]

[Overall Configuration]

Figure 1:
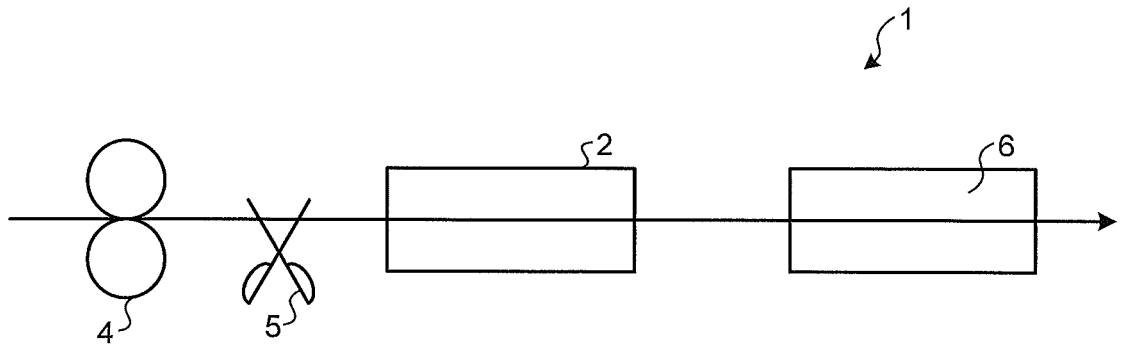
FIG. 1 is a schematic diagram illustrating an overall configuration of a rail-manufacturing equipment according to a first embodiment of the present invention.

An overall configuration of the rail-manufacturing equipment according to the first embodiment of the present invention is described first with reference to FIG. 1.

FIG. 1 is a schematic diagram illustrating the overall configuration of the rail-manufacturing equipment according to the first embodiment of the present invention. As depicted in FIG. 1, this rail-manufacturing equipment 1 according to the first embodiment of the present invention is a device for forcedly cooling a rail having a sectional shape of a product under a predetermined cooling condition depending on required qualities such as desired hardness, and includes a cooling device 2.

The cooling device 2 is a device that performs later-described forced cooling on a hot rail that is hot-rolled by a rolling mill 4 at an austenite region temperature or higher and then, depending on cases, is cut by a cutter 5 or is reheated to the austenite region temperature or higher. The cooling device 2 is installed with the rolling mill along a rail-conveyance path formed with a conveyance device, for example, in a production line. The cooling device 2 forcedly cools the head and the base of a rail that is conveyed to a processing position.

The rail may be conveyed to the cooling device 2 while being kept in a rolled length of about 100 meters, for example, to be cooled, or may be cut (sawn) into pieces each of which is about 25 meters long, for example, and then conveyed to the cooling device 2 to be cooled. Examples of a cooling device that cools sawn rails include a device that has divided cooling zones depending on lengths after the sawing.

The rails forcedly cooled at the cooling device 2 are conveyed to a cooling bed 6.

[Configuration of Cooling Device]

Figure 2:
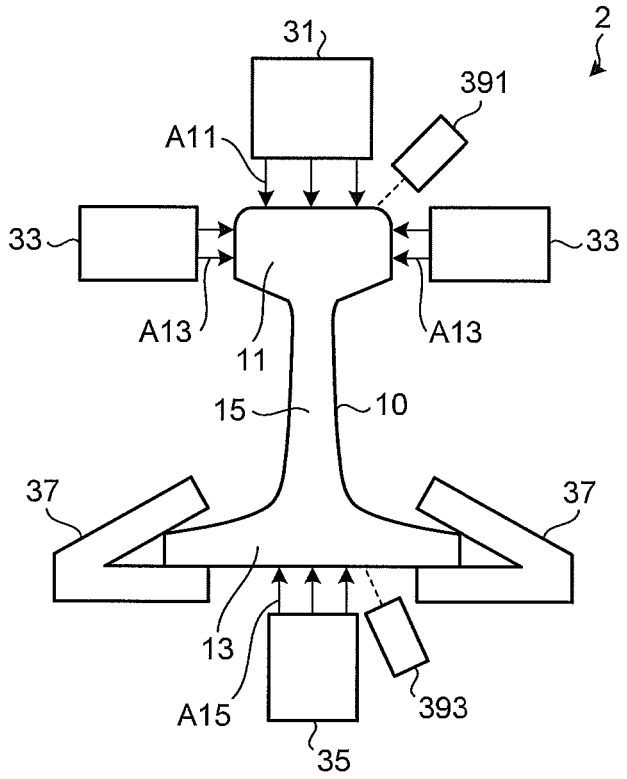
FIG. 2 is a schematic diagram illustrating a configuration of a cooling device depicted in FIG. 1.

The following describes a configuration of the cooling device 2 with reference to FIG. 2.

FIG. 2 is a schematic diagram illustrating the configuration of the cooling device 2 depicted in FIG. 1. As depicted in FIG. 2, the cooling device 2 includes a head-top cooling header 31 and head-side cooling headers 33 both for cooling a head 11 of a rail 10 (the head-top cooling header 31 and the head-side cooling headers 33 are collectively referred to as "head cooling headers"), and a underside-of-the-base cooling header 35 for cooling a base 13 of the rail 10. If necessary, this configuration may further include a cooling header for cooling a web 15 of the rail 1.

Figure 3:
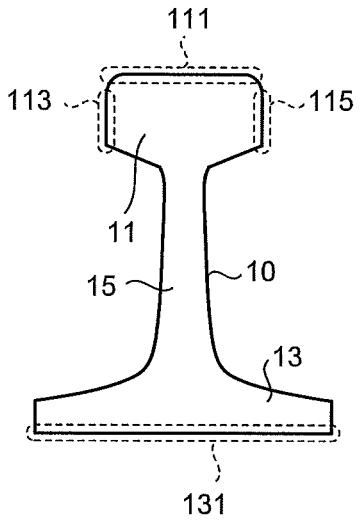
FIG. 3 is a diagram for explaining forcedly cooled positions of a rail.

Each of the head-top cooling header 31, the head-side cooling headers 33, and the underside-of-the-base cooling header 35 (hereinafter, collectively referred to as "cooling headers 31, 33, and 35" as appropriate) is connected to a cooling-medium source via a pipe, and jets a cooling medium (air, spray water, mist, or the like) from a plurality of nozzles (not depicted). Specifically, the nozzles of the head-top cooling header 31 are arranged along the longitudinal direction of the rail 10 above the head 11 of the rail 1 at a processing position, and jet the cooling medium (arrows A11 in FIG. 2) toward a head-top surface 111 of the head 11 depicted in FIG. 3. The nozzles of the head-side cooling headers 33 are arranged along the longitudinal direction of the rail 10 on both sides of the head 11 of the rail 10 at the processing position, and jet the cooling medium (arrows A13 in FIG. 2) toward head-side surfaces 113 and 115 of the head 11 depicted in FIG. 3. The nozzles of the underside-of-the-base cooling headers 35 are arranged along the longitudinal direction of the rail 10 below the base 13 of the rail 10 at the processing position, and jet the cooling medium (arrows A15 in FIG. 2) toward a undersurface (underside of the base) 131 of the base 13 depicted in FIG. 3.

Each of the cooling headers 31, 33, and 35 is configured to be able to control the jet of the cooling medium. In other words, each thereof is configured so that discharge amount or discharge pressure, temperature, and water amount from the cooling headers can be adjusted. This adjustment of discharge amount or discharge pressure, temperature, and water amount of the cooling medium changes cooling capability by the cooling medium, and thus by adjusting these, the cooling rates at the surface of the head 11 and the undersurface of the base 13 are controlled. For example, when configured to use air or spray water as a cooling medium, the cooling headers 31, 33, and 35 only have to be configured so that at least one of the discharge amount, discharge pressure, and temperature of the cooling medium can be controlled. When configured to use mist as a cooling medium, the cooling headers 31, 33, and 35 only have to be configured so that at least one of the discharge amount, the discharge pressure, the temperature, and the water amount can be controlled.

The cooling device 2 also includes a pair of clamps 37 at positions facing each other on both sides of the base 13 of the rail 10 at the processing position. These clamps 37 secure the base 13 of the rail 10 at the processing position from both sides to restrain the displacement thereof so that the rail 10 does not move vertically during the cooling, and a plurality of pairs of the clamps 37 are placed at suitable positions along the longitudinal direction of the rail 10 at the processing position. For example, the clamps 37 are placed at intervals of about five meters along the longitudinal direction of the rail 10 at the processing position.

Figure 4:
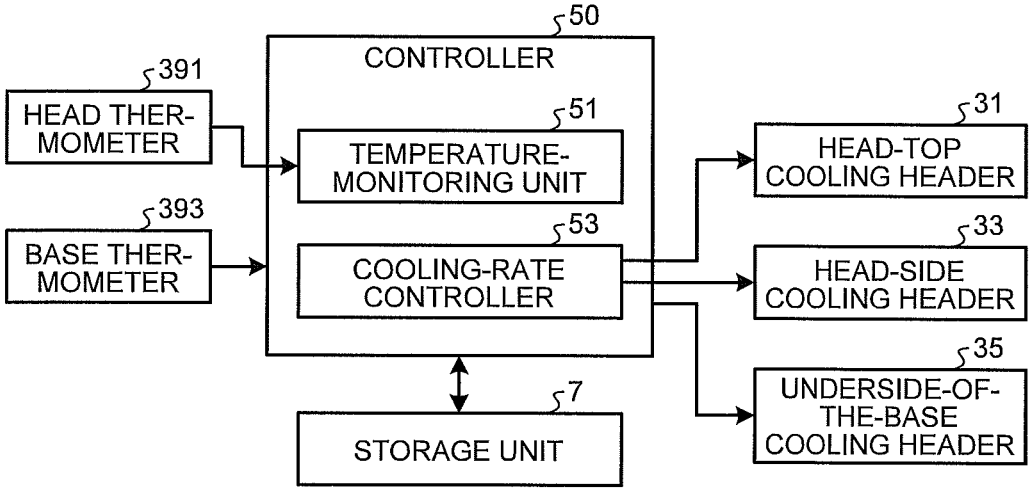
FIG. 4 is a block diagram illustrating a configuration of a control system of the rail-manufacturing equipment depicted in FIG. 1.

The cooling device 2 also includes a head thermometer 391 that is provided above the head 11 of the rail 10 to measure the surface temperature of the head 11 (e.g., one spot in the head-top surface 111) and a base thermometer 393 that is provided below the base 13 of the rail 1 to measure the surface temperature of the base 13 (e.g., one spot in the undersurface 131). The head thermometer 391 and the base thermometer 393 are connected to a controller 50 as depicted in FIG. 4, and output measured values to the controller 50 as needed.

The controller 50 includes a temperature-monitoring unit 51 and a cooling-rate controller 53 as main functional parts. To obtain a high-hardness rail that has high wear resistance and high toughness not only at the surface but also in the inner portion (central portion) of the head 11 of the rail 10, it is important to transform the whole of the head 11 into pearlite. Accordingly, in a process of forced cooling from the start to the end of the forced cooling, the controller 50 controls the cooling rate or the temperature-rising rate at the surface of the head 11 so that the surface temperature of the head 11 is retained or raised during transformation of at least a surface layer of the head 11 (cooling-control processing). In the present embodiment, in the controller 50, the temperature-monitoring unit 51 monitors measurement results from the head temperature 391, i.e., the surface temperature of the head 11 of the rail 10 during the cooling, and the cooling-rate controller 53 controls the jet of the cooling medium from the cooling headers 31, 33, and 35 so that the cooling rate or the temperature-rising rate at the surface of the head 11 follows a rate pattern described later with reference to FIG. 5, based on a surface-temperature history (measurement-result history obtained by the head thermometer 391).

The controller 50 is connected to a storage unit 7 storing therein a program and data, for example, that are necessary for implementing the cooling-control processing. The storage unit 7 is constructed with storage devices including various IC memories such as an update-recordable flash memory and a RAM, a hard disk, and various storage media. In addition, if necessary, the controller 50 is appropriately connected to other devices (not depicted) such as an input device for inputting information required for the above-described temperature monitoring and the cooling-rate control and a display device for monitor-displaying surface temperatures of the head 11 and the base 13 of the rail 10 during the cooling, for example.

Figure 5:
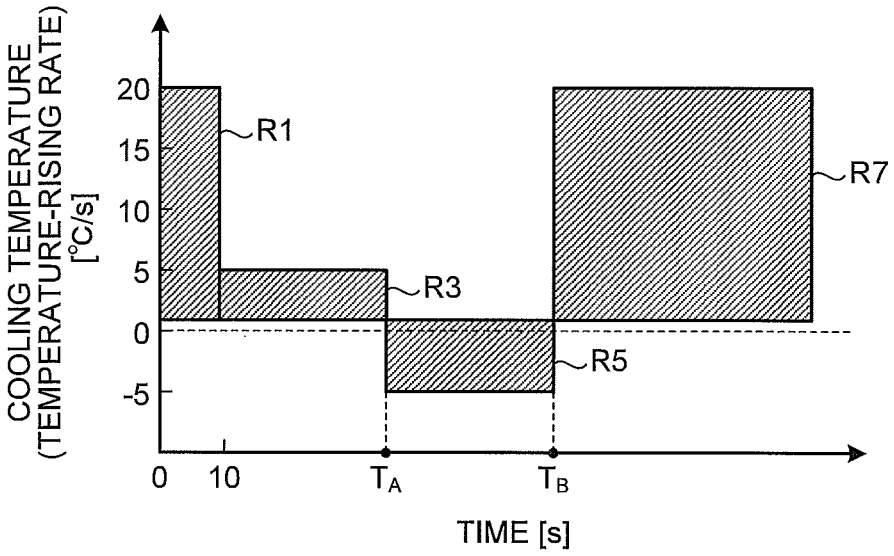
FIG. 5 is a diagram for explaining a rate pattern of cooling rates or temperature-rising rates of a head surface of the rail that is implemented by cooling-control processing according to the first embodiment of the present invention.

A principle of the cooling-control processing is described first. FIG. 5 is a diagram for explaining a rate pattern of cooling rates or temperature-rising rates at the surface of the head 11 that is implemented by the cooling-control processing according to the first embodiment of the present invention.

(1) Cooling Rate for 10 Seconds after Start of Forced Cooling

Although transformation into pearlite generally occurs in a temperature range of 550° C. to 730° C., the inventors of the present invention found that pearlite transformed in a temperature range of 550° C. or higher and 650° C. or lower has high wear resistance and high toughness. The inventors of the present invention also found that a cooling rate at the surface of the head 11 for 10 seconds after the start of forced cooling is preferably set to 1° C./s or higher and 20° C./s or lower for the pearlite transformation in the temperature range of 550° C. or higher and 650° C. or lower.

In view of this, in the cooling-control processing of the present embodiment, as depicted in FIG. 5, for 10 seconds after the start of forced cooling, the cooling rate at the surface of the head 11 is controlled to be in a rate range R1 of 1° C./s or higher and 20° C./s or lower.

In general, when a hot steel material is cooled, the cooling rate is high immediately after the start of forced cooling (e.g., for 10 seconds after the start of forced cooling), and then the cooling rate decreases as the temperature decreases. However, according to the investigations by the inventors of the present invention, if the cooling rate is retained at 20° C./s or lower immediately after the start of forced cooling, bainite transformation or martensite transformation does not occur. Accordingly, even if the cooling rate immediately after the start of forced cooling is set to 1° C./s or higher, it does not cause problems.

(2) Cooling Rate after Lapse of 10 Seconds after Start of Forced Cooling Until Heat Generation During Transformation Begins at Surface of Head 11

The inventors of the present invention found that the surface of the head 11 needs to be cooled at a cooling rate of 1° C./s or higher and 5° C./s or lower after a lapse of 10 seconds after the start of cooling, and the surface of the head 11 needs to be cooled at a cooling rate of 1° C./s or higher and 5° C./s or lower at least until heat generation during transformation begins at the surface of the head 11. When the cooling is performed at a cooling rate over 5° C./s, the transformation temperature becomes excessively low, so that bainite transformation or martensite transformation occurs, resulting in reduction of wear resistance or toughness of the head 11. In contrast, when the cooling is performed at a cooling rate below 1° C./s, the transformation start temperature becomes high, so that the transformation start temperature may increase up to a temperature over 650° C. This situation is not preferable because wear resistance and toughness decrease when the transformation start temperature exceeds 650° C. as described above.

In view of this, in the cooling-control processing of the present embodiment, as depicted in FIG. 5, after the lapse of 10 seconds after the start of forced cooling, until the time $T_A$ when heat generation during transformation begins at the surface of the head 11, the cooling rate at the surface of the head 11 is controlled to be in a rate range R3 of 1° C./s or higher and 5° C./s or lower.

(3) Cooling Rate or Temperature-Rising Rate During Transformation

In an early stage of cooling after the start of forced cooling, the surface temperature of the head 11 gradually decreases, and in response to this decrease in the surface temperature, transformation (pearlite transformation) in the surface layer of the head 11 begins. During the transformation, the cooling rate rapidly decreases because of the heat generation during transformation. Subsequently, along with the proceeding of the transformation, the surface temperature of the head 11 temporarily increases (temperature rises) (the cooling rate becomes a negative value). The surface temperature of the head 11 then starts decreasing again at the time when the pearlite transformation at the surface of the head 11 has almost ended.

The inventors of the present invention found that, to transform the whole of the head 11 into pearlite, after heat generation during transformation begins at the surface of the head 11, the surface temperature of the head 11 is preferably retained or raised at a temperature-rising rate of 5° C./s or lower, whereby the pearlite transformation is promoted. The retaining of the temperature herein means a state in which the cooling rate at the surface of the head 11 is lower than 1° C./s. If the temperature-rising rate is 5° C./s or higher, the heat generation during transformation in the surface layer of the head 11 becomes excessive, and thus the cooling rate in the central portion of the head 11 cannot be retained. Consequently, the transformation temperature increases in the central portion of the head 11, so that the hardness of the central portion of the head 11 decreases, and thus high wear resistance cannot be obtained.

In view of this, in the cooling-control processing of the present embodiment, as depicted in FIG. 5, transformation continues from the time $T_A$ when heat generation during transformation begins at the surface of the head 11 as described above to the time $T_B$ when the heat generation during transformation at the surface of the head 11 ends. During this transformation from $T_A$ to $T_B$, while cooling (jet of the cooling medium) is continued without stop, the cooling is controlled so that the cooling rate at the surface of the head 11 is lower than 1° C./ to retain the temperature at the surface of the head 11, or is controlled so that the temperature-rising rate at the surface of the head 11 is 5° C./s or lower. In other words, the cooling rate at the surface of the head 11 is controlled to be in a rate range R5 equal to or higher than −5° C./s and lower than 1° C./s. The temperature-rising rate of 5° C./s or lower can be achieved by performing jet control of the cooling medium considering the above-described heat generation during transformation while continuing the cooling.

The transformation start time $T_A$ herein may be determined by obtaining in advance a relation between jet conditions of the cooling medium (pressure, flow rate, or the like) and the cooling rate when heat generation during transformation does not occur, and setting as the transformation start time $T_A$ the time when this relation has become unsatisfied, i.e., the time when the cooling rate that is actually obtained, in the case forced cooling is performed under certain jet conditions, becomes lower than the cooling rate obtained from this relation. Alternatively, a certain constant jet condition of the cooling medium in which a cooling rate of 1° C./s or higher and 5° C./s or lower can be achieved before transformation may be obtained in advance, forced cooling may be performed under the certain constant jet condition of the cooling medium thus obtained, and the time when the temperature conversely starts rising may be set as the transformation start time $T_A$. The determined transformation start time $T_A$ does not change significantly by either of the determination methods, and no difference is found therebetween from the viewpoint of preventing the transformation temperature in the central portion of the head 11 from rising. The heat-generation-during-transformation end time $T_B$ at the surface of the head 11 also can be determined in a similar manner, by setting the time when decrease in the cooling rate or temperature rise due to the heat generation during transformation has disappeared as the heat-generation-during-transformation end time $T_B$.

(4) Cooling Rate During Period after End of Heat Generation During Transformation Until Temperature of Head Surface of Rail Becomes 450° C. or Lower The inventors of the present invention found that, by setting the cooling rate at the surface of the head 11 after the transformation in the surface layer of the head 11 has almost ended and the surface temperature of the head 11 has started decreasing again to 1° C./s or higher and 20° C./s or lower, the cooling rate in the central portion of the head 11 can be retained and the hardness of the central portion of the head 11 can be sufficiently increased. Specifically, a hardness of HB370 or higher in the central portion of the head 11 can be achieved by this setting. After the end of the heat generation during transformation, if the cooling rate until the temperature of the head surface of the rail becomes 450° C. or lower is higher than 20° C./s, the cooling is rapidly performed, whereby cracking may occur in part of the rail.

Forced cooling after the end of the heat generation during transformation is performed until the surface temperature of the head 11 of the rail 10 becomes 450° C. or lower. This is because pearlite may be tempered and accordingly the hardness may decrease if the surface temperature of the head 11 is higher than 450° C. after the forced cooling with the cooling device 2. The surface temperature of the head 11 can be measured by the head thermometer 391.

In the present embodiment, the cooling after the end of the heat generation during transformation until the surface temperature of the head of the rail becomes 450° C. or lower is performed by the cooling device 2 alone. However, as described later in a second embodiment, after the temperature inside the head of the rail becomes 550° C. or higher and 650° C. or lower, forced cooling may be performed with another cooling device. In this case, an interval after the cooling by the cooling device 2 ends and until the forced cooling with the other cooling unit starts is preferably five minutes or shorter. The reason for this is described in detail in the second embodiment.

In view of this, in the cooling-control processing of the present embodiment, as depicted in FIG. 5, after the heat-generation-during-transformation end time $T_B$, the cooling rate at the surface of the head 11 is controlled to be in a rate range R7 of 1° C./s or higher and 20° C./ or lower.

Figure 6:
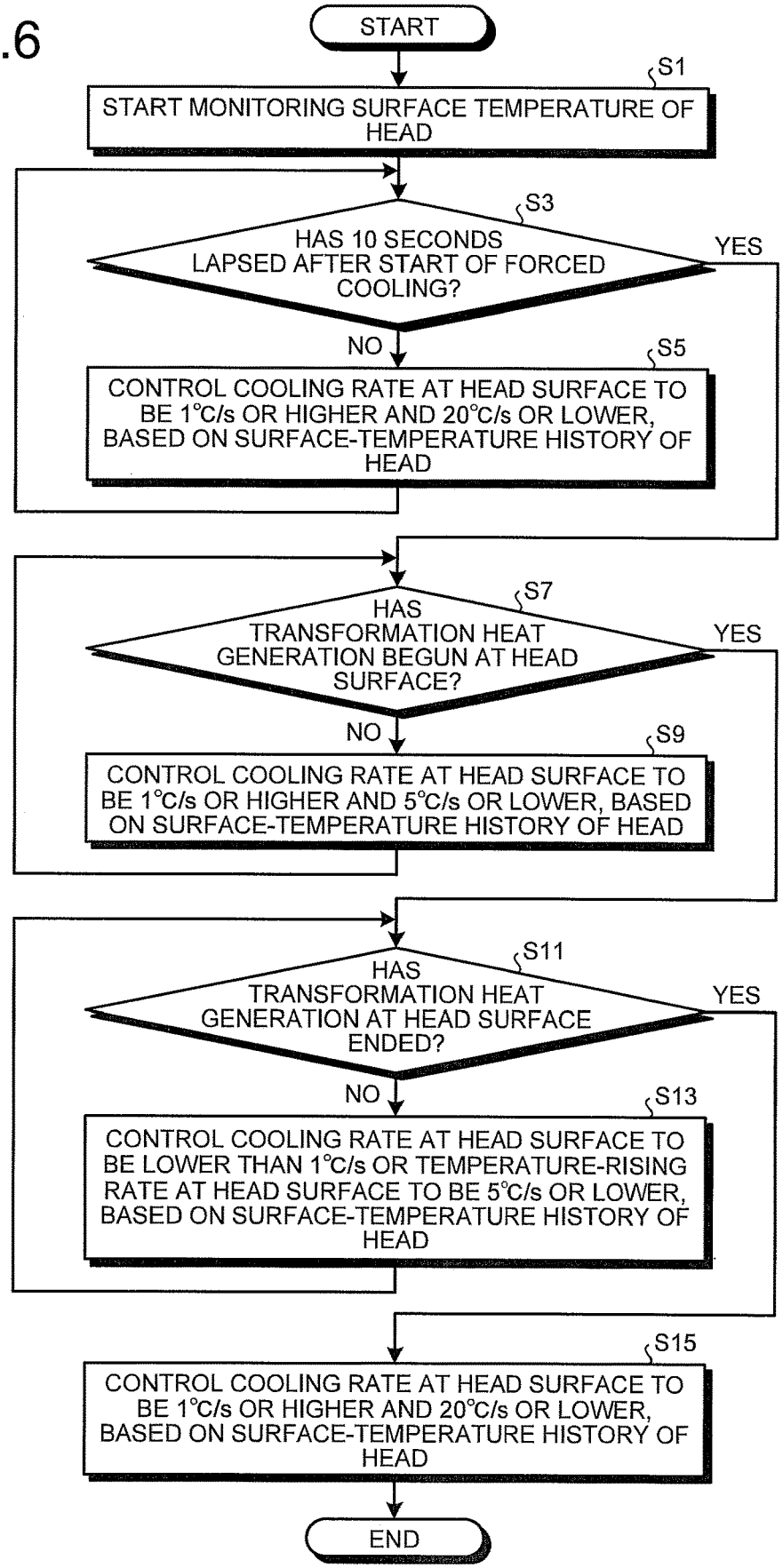
FIG. 6 is a flowchart illustrating a processing procedure of the cooling-control processing according to the first embodiment of the present invention.

The following describes a detailed processing procedure of the cooling-control processing according to the first embodiment of the present invention. FIG. 6 is a flowchart illustrating the processing procedure of the cooling-control processing according to the first embodiment of the present invention. A rail-manufacturing method is executed in such a manner that in the cooling device 2 the cooling-rate controller 53 of the controller 50 performs the cooling-control processing in accordance with the processing procedure in FIG. 6.

The cooling device 2 starts the forced cooling of the rail 10 by jetting the cooling medium from the cooling headers 31, 33, and 35 toward the rail 10 that has been conveyed to the processing position and is in a hot state of an austenite region temperature or higher. At this time, as depicted in FIG. 6, the temperature-monitoring unit 51 starts monitoring the surface temperature of the head 11 on the basis of measured values that are input from the head thermometer 391 as needed (step S1). The cooling-rate controller 53 then controls the jet of the cooling medium from the head-top cooling header 31 and the head-side cooling headers 33 on the basis of the history of the surface temperature of the head 11 that is monitored by the temperature-monitoring unit 51 so that the cooling rate or the temperature-rising rate at the surface of the head 11 follows the rate pattern in FIG. 5 (step S3 to step S15). The controlling of the cooling rate or the temperature-rising rate is performed by stepwise or intermittently changing discharge amount or discharge pressure, temperature, and water amount of the cooling medium as the jet control of the cooling medium from the head-top cooling header 31 and the head-side cooling headers 33.

Specifically, during a period until 10 seconds has lapsed from the start of the forced cooling (No at step S3), the cooling-rate controller 53 controls the cooling rate at the surface of the head 11 to be 1° C./s or higher and 20° C./s or lower on the basis of the surface-temperature history of the head 11 (step S5). During a period after 10 seconds has lapsed from the start of the forced cooling (Yes at step S3) and before the time $T_A$ when heat generation during transformation begins at the surface of the head 11 (No at step S7), the cooling-rate controller 53 controls the cooling rate at the surface of the head 11 to be 1° C./s or higher and 5° C./s or lower on the basis of the surface-temperature history of the head 11 (step S9). Herein, based on the surface-temperature history, i.e., the measurement-result history of the surface of the head 11 from the temperature-monitoring unit 51, the cooling-rate controller 53 determines that the heat-generation-during-transformation beginning time $T_A$ has come at the time when the cooling rate starts decreasing or the time when the temperature conversely starts rising. During transformation after heat generation during transformation begins at the surface of the head 11 (Yes at step S7) and before the time $T_B$ when the heat generation during transformation at the surface of the head 11 ends (No at step S11), the cooling-rate controller 53 controls the cooling rate at the surface of the head 11 to be lower than 1° C./s, or controls the temperature-rising rate at the surface of the head 11 to be 5° C./s or lower on the basis of the surface-temperature history of the head 11 (step S13). After the heat generation during transformation at the surface of the head 11 ends (Yes at step S11), the cooling-rate controller 53 controls the cooling rate at the surface of the head 11 to be 1° C./s or higher and 20° C./s or lower on the basis of the surface-temperature history of the head 11 (step S15). Herein, based on the surface-temperature history, i.e., the measurement-result history of the surface of the head 11 from the temperature-monitoring unit 51, the cooling-rate controller 53 determines that the heat-generation-during-transformation end time $T_B$ has come at the time when the cooling rate stops decreasing or the time when the temperature rising stops.

The controller 5 appropriately controls the jet control of the cooling medium from the underside-of-the-base cooling header 35 along with the above-described processing by using, for example, measured values that are input from the underside-of-the-base thermometer 393 as needed.

Subsequently, cooling remains performed still at the cooling rate of 1° C./s or higher and 20° C./s or lower until the surface temperature of the head 11 becomes a predetermined temperature (cooling-end temperature) of 450° C. or lower, and then the forced cooling is stopped. After the clamps 37 are removed, the rail 1 after the stop of the forced cooling is conveyed from the cooling device 2, is conveyed to the cooling bed 6, and is cooled to the room temperature to become a product.

As described above, according to the present embodiment, the surface temperature of the head 11 during transformation can be retained or raised even after the start of the transformation in the surface layer of the head 11 without stopping the forced cooling. In addition, also in a forced cooling process other than during the transformation in the surface layer of the head 11, the cooling rate at the surface of the head 11 can be suitably controlled. This enables the whole of the head 11 to surely transform into pearlite without transforming into bainite that causes softening or transforming into martensite that reduces toughness. Furthermore, the hardness of the central portion of the head 11 can be sufficiently increased, whereby HB370 or higher can be secured. Thus, without increasing the cooling time, a fine pearlite structure can be obtained in the whole of the head from the surface to the central portion of the head, whereby a rail having high hardness in the whole of the head can be produced.

In the above-described embodiment, the surface temperature of the head 11 (head-top surface 111) is measured by the head thermometer 391, and the cooling rate is controlled based on the history of this surface temperature, but the surface temperature of the head 11 does not necessarily have to be measured. For example, the cooling rate may be controlled by learning past operation records. Specifically, stepwise or intermittent adjustment values may be programmed in advance for one or more out of the discharge amount, discharge pressure, temperature, and water amount of the cooling medium from the head-top cooling header 31 and the head-side cooling headers 33, which can achieve the cooling rate or the temperature-rising rate corresponding to every lapse of time from the start of forced cooling. The jet control of the cooling medium from the head-top cooling header 31 and the head-side cooling headers 33 may be performed in accordance with this program.

In the above-described embodiment, the surface temperature of the head-top surface 111 measured by the head thermometer 391 is monitored, and the cooling rate at the surface of the head 11 is controlled by controlling the jet of the cooling medium from the head-top cooling header 31 and the head-side cooling headers 33 on the basis of the surface-temperature history thereof. Alternatively, the surface temperatures of the head-side surfaces 113 and 115 may be additionally measured and monitored, and the jet control of the cooling medium from the cooling headers 33 may be performed based on the surface-temperature history of the head-side surfaces 113 and 115.

[Second Embodiment]

[Overall Configuration]

An overall configuration of the rail-manufacturing equipment according to the second embodiment of the present invention is described hereinafter with reference to FIG. 7.

Figure 7:
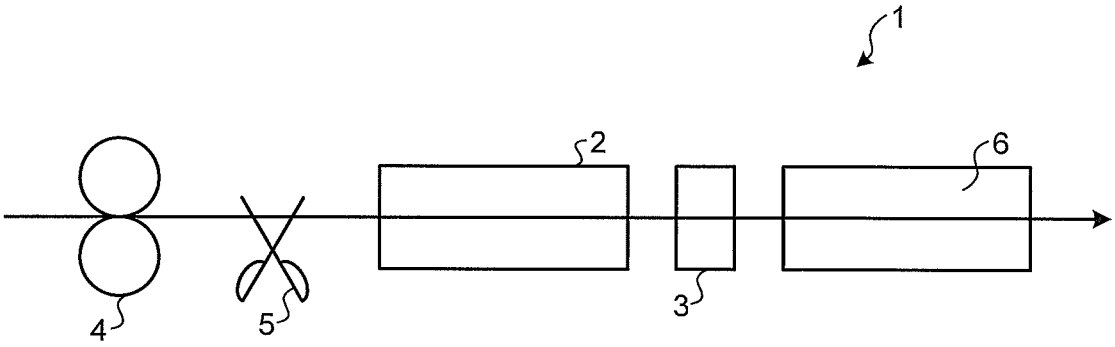
FIG. 7 is a schematic diagram illustrating an overall configuration of a rail-manufacturing equipment according to a second embodiment of the present invention.

FIG. 7 is a schematic diagram illustrating the overall configuration of the rail-manufacturing equipment according to the second embodiment of the present invention. As depicted in FIG. 7, this rail-manufacturing equipment 1 according to the second embodiment of the present invention is a device for forcedly cooling a rail having a sectional shape of a product under a predetermined cooling condition depending on required qualities such as desired hardness, and includes a first cooling device 2 and a second cooling device 3.

The first cooling device 2 is a device that performs later-described first forced cooling on a hot rail that is hot-rolled by a rolling mill 4 at an austenite region temperature or higher and then, depending on cases, is cut by a cutter 5 or is reheated to the austenite region temperature or higher.

The second cooling device 3 is a device that performs later-described second forced cooling on the rail that has been forcedly cooled by the first cooling device 2. The rail that has been forcedly cooled by the second cooling device 3 is conveyed to the cooling bed 6.

[Configuration of First Cooling Device]

The configuration of the first cooling device 2 is almost the same as that depicted in FIG. 2, and explanation of parts having the same configuration is omitted. Note that in the first cooling device 2, the cooling headers (first head cooling headers) 31 and 33 are configured to jet air or mist as cooling media A11 and A13. The cooling headers 31 and 33 are configured to be able to adjust at least one of the discharge amount, discharge pressure, and temperature of a cooling medium 23, and also water amount if the cooling media A11 and A13 are mists.

[Configuration of Second Cooling Device]

Figure 8:
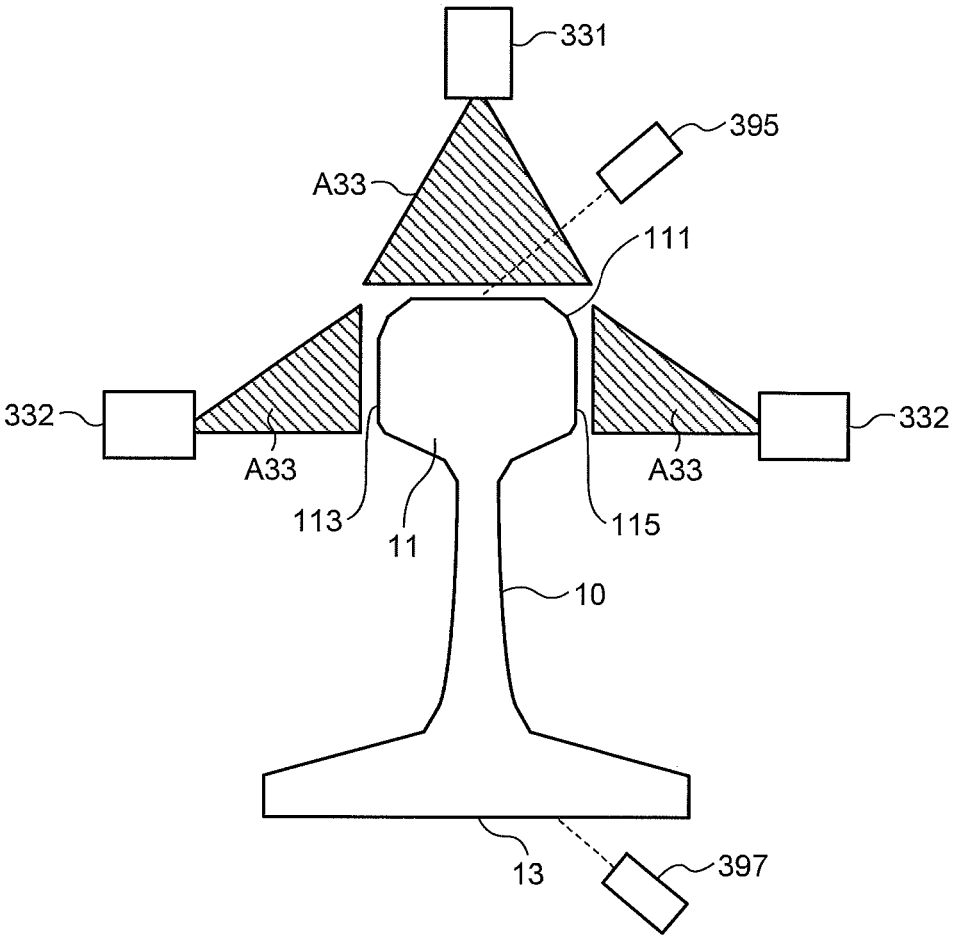
FIG. 8 is a schematic diagram illustrating a configuration of a second cooling device depicted in FIG. 7.

The following describes a configuration of the second cooling device 3 with reference to FIG. 8.

FIG. 8 is a schematic diagram illustrating the configuration of the second cooling device 3 depicted in FIG. 7. As depicted in FIG. 8, the second cooling device 3 includes a head-top cooling header 331 for cooling the head-top surface 111 of the rail 10 and a head-side cooling headers 332 for cooling the head-side surfaces 113 and 115 of the rail 10. The head-top cooling header 331 and the head-side cooling headers 332 of the second cooling device 3 are collectively referred to as second head cooling headers (hereinafter, also simply referred to as "cooling headers"). The second head cooling headers 331 and 332 cool the rail 10 by jetting mist or water as a cooling medium A33. When air is used as the cooling medium A33, construction cost for building the second cooling device 3 increases because of low cooling capability of the air. The cooling headers 331 and 332 are configured to be able to adjust at least one of the discharge amount, discharge pressure, and temperature of the cooling medium A33, and at least one of the discharge amount, discharge pressure, temperature, and water amount of the cooling medium A33 if the cooling medium A33 is mist. The second cooling device 3 also includes a head thermometer (second head thermometer) 395 for measuring the surface temperature of the head 11 (e.g., one spot in the head-top surface 111) and a base thermometer 397 for measuring the surface temperature of the base 13 (e.g., one spot in the underside of the base 13). The head thermometer 395 and the base thermometer 397 are connected to a controller 43 as depicted in FIG. 9, and output measured values to the controller 43 as needed.

[Configuration of Control System]

Figure 9:
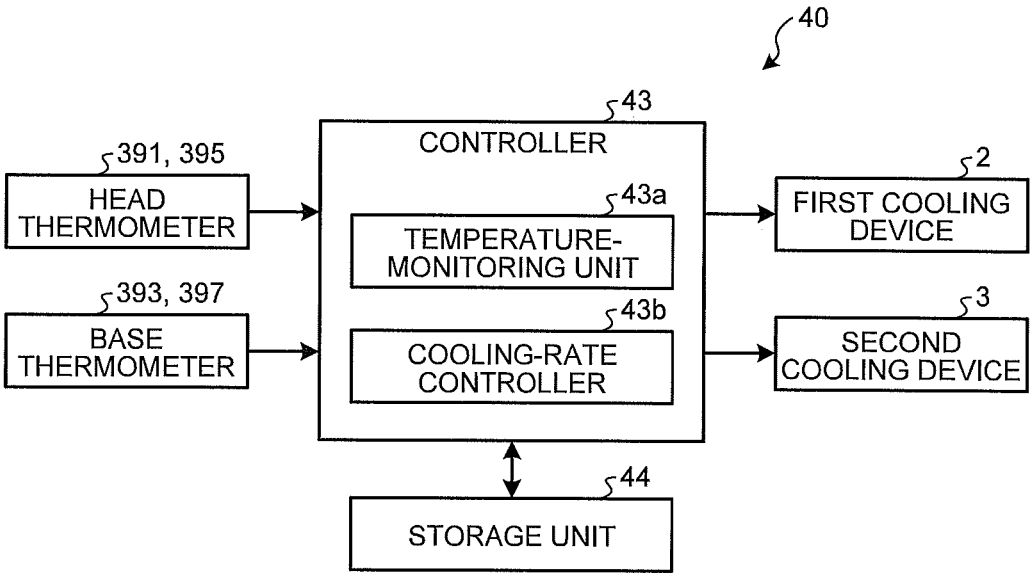
FIG. 9 is a block diagram illustrating a configuration of a control system of the rail-manufacturing equipment depicted in FIG. 7.

The following describes a configuration of a control system of the rail-manufacturing equipment 1 depicted in FIG. 7 with reference to FIG. 9.

FIG. 9 is a block diagram illustrating the configuration of the control system of the rail-manufacturing equipment 1 depicted in FIG. 7. As depicted in FIG. 9, this control system 40 includes the controller 43 and a storage unit 44.

The head thermometer (first head thermometer) 391 of the first cooling device 2 and the head thermometer (second head thermometer) 395 of the second cooling device 3 are arranged above the head 11 of the rail 10 as depicted in FIG. 2 and FIG. 8 for the rail 10. The head thermometers 391 and 395 measure the surface temperatures of the head 11 of the rail 10 during the forced cooling, and input information on the measured surface temperatures to the controller 43.

The base thermometer 393 of the first cooling device 2 and the base thermometer 397 of the second cooling device 3 measure the surface temperatures of the base 13 of the rail 10 during the forced cooling as depicted in FIG. 2 and FIG. 8, and input information on the measured surface temperatures to the controller 43.

The controller 43 includes a temperature-monitoring unit 43*a* and a cooling-rate controller 43*b*. For the head 11 of the rail 10 to have high wear resistance and high toughness not only at the surface but also in the inside (central portion) thereof, it is important to transform the whole of the head 11 of the rail 10 into pearlite as described above. Accordingly, in a process of forced cooling with the first cooling device 2 and the second cooling device 3, the controller 43 controls the cooling rate or the temperature-rising rate at the surface of the head 11 so that the surface temperature of the head 11 is retained or raised during transformation of at least the surface layer of the head 11 (cooling-control processing). In the present embodiment, the controller 43 monitors the surface temperature of the head 11 of the rail during the cooling, and controls the first cooling device 2 and the second cooling device 3 so that the cooling rate or the temperature-rising rate at the surface of the head 11 follows a rate pattern described later with reference to FIG. 10, based on the surface-temperature history.

The controller 43 is connected to the storage unit 44 storing therein a program and data, for example, that are necessary for implementing the cooling-control processing. The storage unit 44 is constructed with storage devices including various IC memories such as an update-recordable flash memory and a RAM, a hard disk, and various storage media. In addition, if necessary, the controller 43 is appropriately connected to other devices (not depicted) such as an input device for inputting information required for the above-described temperature monitoring and the cooling-rate control, for example, and a display device for monitor-displaying surface temperatures and the like of the head 11 and the base 13 of the rail 10 during the cooling, for example.

[Principle of Cooling-Control Processing]

Figure 10:
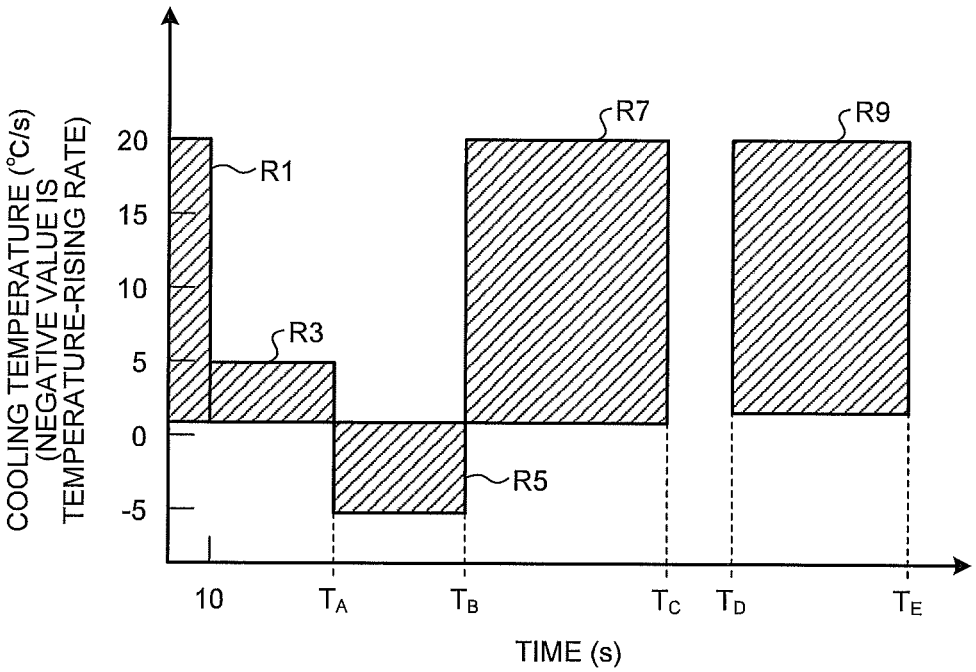
FIG. 10 is a diagram for explaining a rate pattern of cooling rates or temperature-rising rates at a head surface of a rail that is implemented by cooling-control processing according to the second embodiment of the present invention.

The following describes a principle of the cooling-control processing of the present invention with reference to FIG. 10. FIG. 10 is a diagram for explaining a rate pattern of cooling rates or temperature-rising rates at the surface of the head 11 that is implemented by the cooling-control processing according to the second embodiment of the present invention.

(1) Cooling Rate for 10 Seconds after Start of Forced Cooling

In the present embodiment, forced cooling is started with the first cooling device 2. Herein, also in the second embodiment of the present embodiment, for 10 seconds after the start of the forced cooling, the cooling rate at the surface of the head 11 is controlled to be in the rate range R1 (see FIG. 10) of 1° C./s or higher and 20° C./s or lower. The reason for this is the same as the reason described in the first embodiment, and thus explanation thereof is omitted here. The forced cooling is started with the first cooling device 2.

(2) Cooling Rate after Lapse of 10 Seconds after Start of Forced Cooling Until Heat Generation During Transformation Begins in Surface of Head 11

After a lapse of 10 seconds after the start of the forced cooling, forced cooling is successively performed also with the first cooling device 2. Herein, also in the second embodiment of the present invention, after the lapse of 10 seconds after the start of forced cooling, until the time $T_A$ when heat generation during transformation begins at the surface of the head 11, the cooling rate at the surface of the head 11 is controlled to be in the rate range R3 (see FIG. 10) of 1° C./s or higher and 5° C./s or lower. The reason for this is the same as the reason described in the first embodiment, and thus explanation thereof is omitted here.

(3) Cooling Rate or Temperature-Rising Rate During Transformation

After the time $T_A$ when heat generation during transformation begins at the surface of the head 11, the forced cooling is successively performed also with the first cooling device 2. Herein, also in the second embodiment of the present invention, during the transformation, i.e., during a period from the time $T_A$ when heat generation during transformation begins at the surface of the head 11 to the time $T_B$ when the heat generation during transformation at the surface of the head 11 ends, the cooling rate at the surface of the head 11 is controlled to be in the rate range R5 (see FIG. 10) equal to or higher than −5° C./s and lower than 1° C./s. In other words, this control is performed so that the cooling rate at the surface of the head 11 is lower than 1° C./s or the temperature-rising rate at the surface of the head 11 is 5° C./s or higher. The reason for this is the same as the reason described in the first embodiment, and thus explanation thereof is omitted here.

(4) Cooling Rate During Period after End of Heat Generation During Transformation Until Temperature Inside Head of Rail Becomes 550° C. or Higher and 650° C. or Lower As described above, by setting the cooling rate at the surface of the head 11 to 1° C./s or higher and 20° C./s or lower after the transformation in the surface layer of the head 11 almost ends and the surface temperature of the head 11 starts decreasing again, the cooling rate in the central portion of the head 11 can be retained and a hardness of HB370 or higher in the central portion of the head 11 can be achieved. Thus, in the cooling-control processing of the present embodiment, after the heat-generation-during-transformation end time $T_B$, as depicted in FIG. 10, the cooling rate at the surface of the head 11 is controlled to be in the rate range R7 of 1° C./s or higher and 20° C./s or lower. The cooling after the end of the heat generation during transformation is performed also with the first cooling device 2.

Herein, the cooling of the surface layer of the head 11 at 1° C./s or higher and 20° C./s or lower after the heat-generation-during-transformation end time $T_B$ is performed until the temperature inside the head 11 of the rail becomes 550° C. or higher and 650° C. or lower, and the subsequent forced cooling is performed with the second cooling device 3 described later. The reason why the cooling with the first cooling device 2 is continued until the temperature inside the head of the rail becomes 550° C. or higher and 650° C. or lower after the end of heat generation during transformation is to prevent reduction of the hardness inside the head 11 caused by interruption of the forced cooling before the temperature inside the head 11 is cooled down to a temperature range of 550° C. or higher and 650° C. or lower. The period of time until the inner temperature of the head 11 becomes in the range of 550° C. or higher and 650° C. or lower may be determined by measuring the inner temperature of the head 11 with a thermocouple that is provided in the head 11 in advance, or by investigating the cooling time when the pearlite transformation ends by the cooling after the end of heat generation during transformation in the surface layer of the head 11.

(5) Cooling Rate after Inner Temperature of Head is Forcedly Cooled to 550° C. or Higher and 650° C. or Lower by First Cooling Device Until Surface Temperature of Head Becomes 450° C. or Lower by Second Cooling Device 3

The inventors of the present invention found that the cooling rate in the second cooling device 3 during a period until the rail forcedly cooled by the first cooling device 2 is conveyed to the cooling bed 6 is preferably 2° C./s or higher and 20° C./s or lower. It was found that the hardness tends to decrease if the cooling rate is lower than 2° C./s in comparison with the case when the cooling rate is 2° C./s or higher. This is because the pearlite is tempered. If the cooling rate is higher than 20° C./s, the rapid cooling is performed, whereby cracking may occur in part of the rail. In view of this, in the cooling-control processing of the present embodiment, as depicted in FIG. 10, in a time period (time $T_D$ to $T_E$) of forced cooling with the second cooling device 3, the cooling rate at the surface of the head 11 is controlled to be in a rate range R9 of 2° C./s or higher and 20° C./s or lower.

In the second cooling device 3, after the forced cooling with the first cooling device 2, it is desirable to start forced cooling as soon as possible after recuperation, and it is desirable to start forced cooling preferably within five minutes after the forced cooling with the first cooling device 2 ends. This is because, if the forced cooling is started five minutes or longer after the forced cooling with the first cooling device 2 ends, the pearlite is tempered during a period before the forced cooling with the second cooling device 3 is performed, and the hardness does not increase even if cooling by the second cooling device 3 is subsequently performed. In view of this, it is desirable that the second cooling device 3 be installed between the first cooling device 2 and the cooling bed 6.

The second cooling device 2 performs the forced cooling until the surface temperature of the head 11 of the rail 10 becomes 450° C. or lower. This is because, if the surface temperature of the head 11 is higher than 450° C. after the forced cooling with the second cooling device 3, the pearlite is tempered, whereby the hardness may be reduced. The surface temperature of the head can be measured by the head thermometer 395. The undersurface of the base 13 may be cooled in order to suppress warp of the rail 10 caused by the forced cooling.

The second cooling device 3 is preferably a passing-type cooling device. This is because the purpose of the forced cooling with the second cooling device 3 is to suppress tempering of pearlite, and the cooling only has to be performed within five minutes after the forced cooling in the first cooling device 2 ends as described above, and thus the cooling does not necessarily have to be performed at the same timing in the longitudinal direction of the rail 10. Accordingly, the size of the cooling facility can be reduced, whereby construction cost can be reduced.

Figure 11:
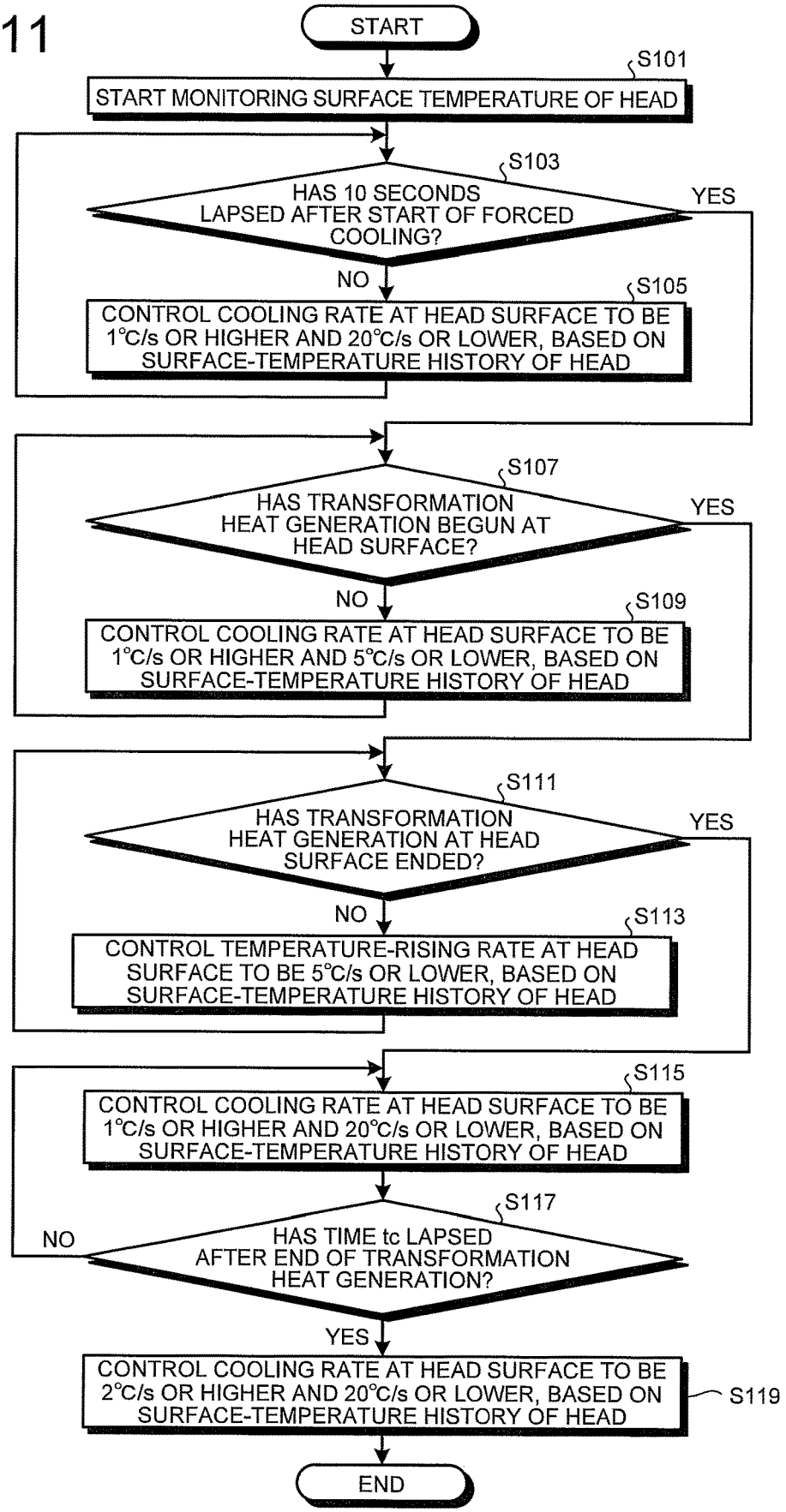
FIG. 11 is a flowchart illustrating a processing procedure of the cooling-control processing according to the second embodiment of the present invention.

The following describes a detailed processing procedure of the cooling-control processing according to the second embodiment of the present invention. FIG. 11 is a flowchart illustrating the processing procedure of the cooling-control processing according to the second embodiment of the present invention. In the rail-manufacturing equipment 1 of the present embodiment, a rail-manufacturing method is executed in such a manner that the controller 43 performs the cooling-control processing in accordance with the processing procedure in FIG. 11.

In the rail-manufacturing equipment 1 of the present embodiment, the first cooling device 2 and the second cooling device 3 start the forced cooling of the rail by jetting the cooling medium toward the rail that has been conveyed to the processing position and is in a hot state at an austenite region temperature or higher. At this time, as depicted in FIG. 11, the temperature-monitoring unit 43*a* starts monitoring the surface temperature of the head 11 on the basis of measured values that are input from the head thermometers 391 and 395 as needed (step S101). The cooling-rate controller 43*b* then controls the jet of the cooling medium from the first cooling device 2 and the second cooling device 3 on the basis of the history of the surface temperature of the head 11 that is monitored by the temperature-monitoring unit 43*a* so that the cooling rate or the temperature-rising rate at the surface of the head 11 follows the rate pattern in FIG. 10 (step S103 to step S119). The controlling of the cooling rate or the temperature-rising rate is performed by stepwise or intermittently changing the discharge amount, discharge pressure, temperature, or water amount of the cooling medium as the jet control of the cooling medium from the first cooling device 2 and the second cooling device 3.

In the flowchart depicted in FIG. 11, at step S101 to step S113, the cooling-rate controller 43*b* performs the jet control of the cooling medium on the first cooling device 2, and the first cooling device 2 performs forced cooling of the rail 10. These processings are the same as the processings in the first embodiment described above (respectively corresponding to step S1 to step S13 in FIG. 6), and thus detailed explanation of the processings is omitted.

If it is determined that the heat generation during transformation at the surface of the head 11 ends in the processing at step S111 (Yes at step S111), the cooling-rate controller 43*b* controls the cooling rate at the surface of the head 11 to be 1° C./s or higher and 20° C./s or lower (step S115). The cooling-rate controller 43*b* then determines whether the time tc that is set in advance has come after the end of the heat generation during transformation at the surface of the head 11 (step S117). The time tc is set as the time when the temperature inside the head 11 reaches a preset temperature in a range of 550° C. or higher and 650° C. or lower while cooling is performed at a cooling rate set in a range of 1° C./s or higher and 20° C./s or lower after the end of the heat generation during transformation at the surface of the head 11. In other words, the processing at step 117 is processing for determining the timing to end cooling at a cooling rate set in a range of 1° C./s or higher and 20° C./s or lower after the end of the heat generation during transformation at the surface of the head 11. If the time tc has not come (No at step 117), the cooling-rate controller 43*b* controls the cooling rate at the surface of the head 11 to be 1° C./s or higher and 20° C./s or lower, and the processings at step 115 and step 117 are repeated until the time tc comes.

If the time tc has come (Yes at step 117), the cooling-rate controller 43*b* instructs the first cooling device 2 to stop the forced cooling, and also instructs the manufacturing equipment 1 to convey the rail 10 to the second cooling device 3. The cooling-rate controller 43*b* sets the cooling rate in the second cooling device 3 to be 2° C./s or higher and 20° C./s or lower (step S119). The forced cooling with the second cooling device 3 is continued until the surface temperature of the head 11 reaches the predetermined temperature (cooling-end temperature), and the forced cooling ends when the surface temperature of the head 11 becomes the cooling-end temperature. The surface temperature of the head 11 is measured by the head thermometer 395. The predetermined cooling-end temperature is the surface temperature of the head 11 of the rail at 450° C. or lower. The rail 1 after the forced cooling ends is conveyed out of the second cooling device 3, conveyed to the cooling bed 6, and is cooled down to the room temperature to be a product.

As described above, according to the present embodiment, the surface temperature of the head 11 during transformation can be retained or raised even after the start of the transformation in the surface layer of the head 11 without stopping the forced cooling. In addition, also in a process of forced cooling other than during the transformation in the surface layer of the head 11, the cooling rate at the surface of the head 11 can be suitably controlled. This enables the whole of the head 11 to surely transform into pearlite without transforming into bainite that causes softening or transforming into martensite that reduces toughness. Furthermore, the hardness of the central portion of the head 11 can be sufficiently increased, whereby HB370 or higher can be secured. Thus, without increasing the cooling time, a fine pearlite structure can be obtained in the whole of the head from the surface to the central portion of the head 11, whereby a rail having high hardness in the whole of the head 11 can be produced.

In the present embodiment described above, the first cooling device 2 is configured so that the cooling headers 31 and 33 jet air or mist as a cooling medium, and the second cooling device 3 is configured so that the cooling headers 331 and 332 jet mist or water as a cooling medium. However, if the cooling-rate conditions in the present invention can be satisfied, the cooling medium of the first cooling device 2 is not necessarily limited to air or mist, and the cooling medium of the second cooling device 3 is not necessarily limited to mist or water.

However, when water is used as the cooling medium, local overcooling easily occurs. In the forced-cooling process by the first cooling device 2, pearlite transformation occurs at the surface of the head 11 of the rail, but if local overcooling occurs at the surface of the head 11 during the forced cooling with the first cooling device 2, martensite or bainite may be generated locally in the surface layer. Thus, in the forced-cooling process by the first cooling device 2, air or mist is preferably used.

In the forced-cooling process by the second cooling device 3, because pearlite transformation has already ended in the surface layer of the head 11, the purpose of the forced cooling is to prevent reduction of hardness due to tempering of the pearlite. Thus, using water does not influence wear resistance or toughness of the head 11 of the rail, and thus water having high cooling capability can be used. If air is used as the cooling medium in the second cooling device 3, because of low cooling capability of air, a large facility is required to obtain the above-described cooling, which increases construction cost. To prevent an increase in the size of the facility, mist or water is preferably used for the second cooling device 3.

In the present embodiment, the surface temperature of the head 11 is measured by the head thermometers 391 and 395, and the cooling rate is controlled based on the history of this surface temperature, but the surface temperature of the head 11 does not necessarily have to be measured. For example, the cooling rate may be controlled by learning past operation records. Specifically, stepwise or intermittent adjustment values may be programmed in advance for one or more out of the discharge amount, discharge pressure, temperature, and water amount of the cooling medium from the cooling headers, which can achieve the cooling rate or the temperature-rising rate corresponding to every lapse of time from the start of forced cooling. The jet control of the cooling medium from the cooling headers may be performed in accordance with this program.

While the chemical composition of a rail produced by the above-described manufacturing method is not limited to particular one, the following describes one example thereof. In the following description, "%" denoting the content of a component element of a billet means "percent by mass (mass %)" unless otherwise specified.

(Content of C)

The content of C (carbon) is in a range of 0.70% or more and 0.85% or less. C is an important element that forms cementite for a pearlite rail so as to increase hardness and strength, thereby enhancing wear resistance. Because these effects are small when the C content is less than 0.70%, the lower limit of the C content is 0.70%. An increase in the C content means an increase in a cementite content and is expected to increase the hardness and the strength, but conversely reduces the ductility. Furthermore, the increase in the C content expands the $\gamma+\theta$ temperature range, thereby promoting the softening of a weld heat-affected zone. In consideration of these adverse effects, the upper limit of the C content is 0.85%.

(Content of Si)

The content of Si (silicon) is in a range of 0.1% or more and 1.5% or less. Si is added into a rail material to serve as a deoxidizing agent and to strengthen the pearlite structure. Because these effects are small when the Si content is less than 0.1%, the lower limit of the Si content is 0.1%. The upper limit of the Si content is 1.5% because an increase in the Si content promotes decarburization thereby promoting generation of surface flaws of the rail. The content of Si is preferably in a range of 0.2% or more and 1.3% or less.

(Content of Mn)

The content of Mn (manganese) is in a range of 0.01% or more and 1.5% or less. Mn is an element that lowers the transformation temperature into pearlite and has an effect of making pearlite lamellar spacing finer, and thus is effective in retaining high hardness inside the rail. Because these effects are small when the Mn amount is less than 0.01%, the lower limit of the Mn amount is 0.01%. On the other hand, addition of Mn exceeding 1.5% lowers the equilibrium transformation temperature (TE) of pearlite and also facilitates transformation into martensite. Thus, the upper limit of the Mn content is 1.5%. The content of Mn is preferably in a range of 0.3% or more and 1.3% or less.

(Content of P)

The content of P (phosphorus) is in a range of 0.001% or more and 0.035% or less. The upper limit of the P content is 0.035% because the P content exceeding 0.035% reduces toughness or ductility. The upper limit of the P content is preferably 0.025%. The lower limit of the P content is 0.001% because performing special refinement, for example, to reduce the P content induces an increase in cost of smelting.

(Content of S)

The content of S (sulfur) is in a range of 0.0005% or more and 0.030% or less. The upper limit of the S content is 0.030% because S forms coarse MnS extending in the rolling direction thereby reducing ductility or toughness. On the other hand, the lower limit of the S content is 0.0005% because reducing the S content to below 0.0005% induces a significant increase in cost of smelting, such as an increase in time for smelting process. The content of S is preferably in a range of 0.001% or more and 0.015% or less.

(Content of Cr)

The content of Cr (chromium) is in a range of 0.1% or more and 2.0% or less. Cr raises the equilibrium transformation temperature (TE) of pearlite, thereby contributing to achieving finer pearlite lamellar spacing to increase hardness and strength. For this effect, addition of 0.1% or more is necessary, and thus the lower limit of the Cr content is 0.1%. On the other hand, addition of Cr exceeding 2.0% increases occurrence of weld defects and also increases hardenability, thereby promoting generation of martensite. Thus, the upper limit of the Cr content is 2.0%. The content of Cr is preferably in a range of 0.2% or more and 1.5% or less.

While the chemical composition of the billet has been described above, the billet may further contain the following component elements as necessary in addition to the above-described chemical composition.

(Contents of Cu, Ni, Mo, V, and Nb)

It is preferable that at least one selected from elements of Cu (copper), Ni (nickel), Mo (molybdenum), V (vanadium), and Nb (niobium) be contained at contents described below.

When Cu is contained, the content thereof is in a range of 1.0% or less. Cu is an element that enables the hardness to be further increased by solution strengthening. Cu is also effective in suppressing decarburization. To obtain these effects, Cu is preferably added at 0.01% or more. On the other hand, the upper limit of the Cu content is 1.0% because addition of Cu exceeding 1.0% easily induces surface cracking during continuous casting or during rolling. The content of Cu is preferably in a range of 0.05% or more and 0.6% or less.

When Ni is contained, the content thereof is in a range of 0.5% or less. Ni is an element effective in enhancing toughness or ductility. Ni is also an element that is effective in suppressing Cu cracking when Ni is added with Cu in combination, and thus it is desirable that Ni be added when Cu is added. To obtain the effect of Ni, the Ni content is preferably 0.01% or more. The upper limit of the Ni content is 1.0% because addition of Ni exceeding 1.0% increases hardenability thereby promoting generation of martensite. The content of Ni is preferably in a range of 0.05% or more and 0.6% or less.

When Mo is contained, the content thereof is in a range of 0.5% or less. Mo is an element effective in increasing hardness. Because this effect is small when the Mo content is less than 0.01%, the Mo content is preferably 0.01% or more. However, because addition of Mo exceeding 0.5% increases hardenability, so that martensite is generated, and that toughness and ductility are significantly reduced. Thus, the upper limit of the Mo content is 0.5%. The content of Mo is preferably in a range of 0.05% or more and 0.3% or less.

When V is contained, the content thereof is in a range of 0.15% or less. V is an element that forms VC, VN, or the like and then finely precipitates in ferrite, and is effective in increasing hardness through precipitation strengthening. V also functions as a trap site for hydrogen, so that the effect of suppressing delayed fracture can be expected. For obtaining this effect, V is preferably added at 0.001% or more. On the other hand, the upper limit of the V content is 0.15% because addition of V exceeding 0.15% saturates these effects and also significantly increases alloy cost. The content of V is preferably in a range of 0.005% or more and 0.12% or less.

When Nb is contained, the content thereof is in a range of 0.030% or less. Nb is an element that raises the non-recrystallization temperature of austenite, is effective in making pearlite colonies or the block size finer by introducing processing strain into austenite during rolling, and is effective in enhancing ductility and toughness. To obtain these effects, Nb is preferably added at 0.001% or more. On the other hand, the upper limit of the Nb content is 0.030% because addition of Nb exceeding 0.030% crystallizes Nb carbonitride in a solidification process thereby reducing cleanliness. The content of Nb is preferably in a range of 0.003% or more and 0.025% or less.

(Contents of Ca and REM)

At least one selected from elements of Ca (calcium) and REM (rear-earth metals) is preferably contained in the content described below. Specifically, Ca or REM is bonded to O (oxygen) and S in steel during solidification to form oxysulfide particulate, which improves ductility/toughness and delayed-fracture properties. To obtain these effects, it is preferable that Ca be contained at 0.0005% or more and REM be contained at 0.005% or more. However, excessive addition of Ca or REM conversely reduces cleanliness. Thus, when Ca and/or REM is added, the content of Ca is in a range of 0.010% or less, and the content of REM is in a range of 0.1% or less. It is preferable that the content of Ca be in a range of 0.0010% or more and 0.0070% or less, and the content of REM be in a range of 0.008% or more and 0.05% or less.

The balance other than the components of contents described above includes Fe (iron) and unavoidable impurities. Within a range in which the effects of the present invention are not impaired, other components than those described above may be contained without rejection. The content of N (nitrogen) may be 0.015% or less, and the content of O may be 0.004% or less. AlN and TiN deteriorate rolling-fatigue properties, and thus the content of Al (aluminum) is preferably reduced to 0.003% or less, and the content of Ti (titanium) is preferably reduced to 0.003% or less.

EXAMPLES

Rails were produced by using the above-described rail-manufacturing equipment 1 (see FIG. 1) according to the first embodiment of the present invention. As a steel material, eutectoid pearlite with the carbon content in a range of 0.70 to 0.85 mass % was used. Forced cooling was actually performed on a rail with the cooling rate or the temperature-rising rate changed for 10 seconds from the start of the forced cooling, after a lapse of 10 seconds to the temperature-rising start time $T_A$, during the transformation from $T_A$ to $T_B$, and after the temperature-rising end time $T_B$. The structure of the head and the hardness of the central portion (center hardness) of the head were evaluated after air cooling to the room temperature (Example 1 to Example 12 and Comparative Example 1 to Comparative Example 8). Table 1 lists the cooling rates, structures of the head, and center hardnesses of Example 1 to Example 12, and Comparative Example 1 to Comparative Example 8.

records, discharge pressure of the cooling medium was determined in advance that could achieve the cooling rate or the temperature-rising rate corresponding to every lapse of time from the start of forced cooling. In accordance of each discharge pressure thus determined, the jet of coolant from the head-top cooling header 31 and the head-side cooling headers 33 was controlled to control the cooling rate and the temperature-rising rate. Air was used as the cooling medium. The temperature-rising rate of −0.5° C./s in Example 7 corresponds to a cooling rate of 0.5° C./s, which is in a state of the retained temperature. Subsequently, at the time when the surface temperature of the head had become 450° C., the forced cooling was stopped. After the stop of the cooling, the rail was removed from the clamps 37, and was conveyed to the cooling bed to be air-cooled to the room temperature. The sample (rail) air-cooled to the room temperature was then cut, and structure observation and a hardness test of the head were performed. The structure of the head was evaluated by observing the cut section of the sample with a scanning electron microscope (SEM). As the hardness test of the head, the hardness (HB) at the position of 25 millimeters deep from the head-top surface was evaluated by Brinell hardness test to use this value as the center hardness.

TABLE 1

| | Cooling rate [° C./s] <Start of forced cooling to 10 s> | Cooling rate [° C./s] <10 s to beginning of transformation heat generation> | Temperature-rising rate [° C./s] <During transformation> | Cooling rate [° C./s] <After end of transformation heat generation> | Structure of head | Center hardness (HB) |
|---|---|---|---|---|---|---|
| Example 1 | 1 | 3 | 3 | 5 | Pearlite | 376 |
| Example 2 | 5 | 3 | 3 | 5 | Pearlite | 383 |
| Example 3 | 10 | 3 | 3 | 5 | Pearlite | 385 |
| Example 4 | 20 | 3 | 3 | 5 | Pearlite | 394 |
| Example 5 | 10 | 1 | 3 | 5 | Pearlite | 382 |
| Example 6 | 10 | 5 | 3 | 5 | Pearlite | 388 |
| Example 7 | 10 | 3 | −0.5 (temperature retained) | 5 | Pearlite | 372 |
| Example 8 | 10 | 3 | 0 | 5 | Pearlite | 378 |
| Example 9 | 10 | 3 | 1 | 5 | Pearlite | 380 |
| Example 10 | 10 | 3 | 5 | 5 | Pearlite | 370 |
| Example 11 | 10 | 3 | 3 | 1 | Pearlite | 370 |
| Example 12 | 10 | 3 | 3 | 10 | Pearlite | 390 |
| Comparative Example 1 | 0.5 | 3 | 3 | 5 | Pearlite | 350 |
| Comparative Example 2 | 30 | 3 | 3 | 5 | Bainite | 380 |
| Comparative Example 3 | 10 | 0.5 | 3 | 5 | Pearlite | 331 |
| Comparative Example 4 | 10 | 10 | −10 | 10 | Bainite + Martensite | 721 |
| Comparative Example 5 | 10 | 2 | −2 | 2 | Pearlite + Bainite | 344 |
| Comparative Example 6 | 10 | 3 | 10 | 5 | Pearlite | 362 |
| Comparative Example 7 | 10 | 3 | 3 | 0.5 | Pearlite | 351 |
| Comparative Example 8 | 10 | 3 | 3 | 30 | Pearlite (Martensite exists in center) | 699 |

(1) Example 1 to Example 12

In Example 1 to Example 12, a long rail the hot-rolling of which had been finished at 900° C. was conveyed to a heat-treatment device 3, and was restrained by the clamps 37. Subsequently, from a state in which the surface temperature of the head was 750° C., the cooling headers 31, 33, and 35 started jetting coolant, and the cooling-control processing in FIG. 6 was performed to control the cooling rate at the head surface within the range of the invention listed in Table 1. In these examples, based on past operation Consequently, in every case of Example 1 to Example 12 in which the cooling rate or the temperature-rising rate was controlled within the range of the invention, a fine pearlite structure was observed in the whole of the head, and a center hardness of HB370 or higher as a target value was achieved.

(2) Comparative Example 1 to Comparative Example 8

In Comparative Example 1 to Comparative Example 8, a long rail the hot-rolling of which had been finished at 900°

C. was conveyed to a heat-treatment device 3, and was restrained by the clamps 37. Subsequently, from a state in which the surface temperature of the head was 750° C., the cooling headers 31, 33, and 35 started jetting coolant, and the cooling rate at the head surface was controlled to be outside the range of the invention in one or more out of the periods for 10 seconds from the start of the forced cooling, after a lapse of 10 seconds to the temperature-rising start time $T_A$, during the transformation from $T_A$ to $T_B$, and after the temperature-rising end time $T_B$ as listed in Table 1. In these comparative examples, based on the past operation records, discharge pressure of the cooling medium was determined in advance that could achieve the cooling rate or the temperature-rising rate corresponding to every lapse of time from the start of forced cooling. In accordance of each discharge pressure thus determined, the jet of coolant from the head-top cooling header 31 and the head-side cooling headers 33 was controlled to control the cooling rate and the temperature-rising rate. Air was used as the cooling medium. Subsequently, at the time when the surface temperature of the head had become 450° C., the forced cooling was stopped. After the stop of the cooling, the rail was removed from the clamps 37, and was conveyed to the cooling bed to be air-cooled to the room temperature. The sample (rail) air-cooled to the room temperature was then cut, and structure observation and a hardness test of the head were performed. The structure of the head was evaluated by observing the cut section of the sample with a SEM. As the hardness test of the head, the hardness (HB) at the position of 25 millimeters deep from the head-top surface was evaluated by Brinell hardness test to use this value as the center hardness.

Consequently, in Comparative Examples 1, 3, 5, 6, and 7, the center hardness of HB370 as the target value could not be achieved. Furthermore, in Comparative Examples, 2, 4, 5, and 8, bainite or martensite existed in the head surface and/or the head central portion, and not the whole of the head could have the pearlite structure.

A steel material that had been rolled into a rail shape at an austenite region temperature was forcedly cooled by using the above-described rail-manufacturing equipment depicted in FIG. 7 according to the second embodiment of the present invention. As a steel material, eutectoid pearlite with the carbon content in a range of 0.70 to 0.85% was used. The forced cooling was started from 750° C., and the subsequent cooling conditions were set as listed in Table 2 below. The discharge amount of the cooling medium during the forced cooling was determined in advance, and the cooling medium was jet so that the specific cooling rate, the specific temperature-rising rate, or the specific cooling-stop temperature was achieved. The temperature-rising rate (−0.5° C./s) during transformation in Example 106 means a cooling rate of 0.5° C./s. The cooling-stop temperature is the inner temperature of the head (at 25 millimeters deep from the head-top surface) in the first cooling device, and is the surface temperature at the top of the head in the second cooling device. After the stop of the cooling, the rail was placed in the cooling bed to be cooled to the room temperature. The sample was collected from the rail after the cooling, and structure and a hardness test were performed (Examples 101 to 117 and Comparative Examples 101 to 109). As typical values, the structure in the surface layer (at two millimeters deep) from the top of the head toward the vertical direction and Brinell harness in an inner portion (at 25.4 millimeters deep) are listed in Table 2.

TABLE 2

| | First cooling device | | | | | Second cooling device | | Evaluation | |
|---|---|---|---|---|---|---|---|---|---|
| | Cooling temperature (° C./s) Start of cooling to 10 s | Cooling temperature (° C./s) 10 s to beginning of transformation heat generation | Temperature rising rate (° C./s) During transformation | Cooling rate (° C./s) After end of transformation heat generation | Cooling stop temperature (° C.) | Cooling rate (° C./s) | Cooling stop temperature (° C.) | Surface layer structure | Hardness of inner portion |
| Example 101 | 10 | 3 | 3 | 5 | 600 | 5 | 450 | Pearlite | 390 |
| Example 102 | 1 | 3 | 3 | 5 | 600 | 5 | 450 | Pearlite | 381 |
| Example 103 | 20 | 3 | 3 | 5 | 600 | 5 | 450 | Pearlite | 399 |
| Example 104 | 10 | 1 | 3 | 5 | 600 | 5 | 450 | Pearlite | 387 |
| Example 105 | 10 | 5 | 3 | 5 | 600 | 5 | 450 | Pearlite | 393 |
| Example 106 | 10 | 3 | −0.5 | 5 | 600 | 5 | 450 | Pearlite | 377 |
| Example 107 | 10 | 3 | 0 | 5 | 600 | 5 | 450 | Pearlite | 383 |
| Example 108 | 10 | 3 | 5 | 5 | 600 | 5 | 450 | Pearlite | 375 |
| Example 109 | 10 | 3 | 3 | 1 | 600 | 5 | 450 | Pearlite | 375 |
| Example 110 | 10 | 3 | 3 | 10 | 600 | 5 | 450 | Pearlite | 395 |
| Example 111 | 10 | 3 | 3 | 5 | 650 | 5 | 450 | Pearlite | 375 |
| Example 112 | 10 | 3 | 3 | 5 | 550 | 5 | 450 | Pearlite | 395 |
| Example 113 | 10 | 3 | 3 | 5 | 600 | 2 | 450 | Pearlite | 385 |
| Example 114 | 10 | 3 | 3 | 5 | 600 | 10 | 450 | Pearlite | 420 |
| Example 115 | 10 | 3 | 3 | 5 | 600 | 5 | 350 | Pearlite | 390 |
| Example 116 | 10 | 3 | 3 | 5 | 450 | — | — | Pearlite | 390 |
| Example 117 | 10 | 3 | 3 | 5 | 600 | 20 | 450 | Pearlite | 445 |
| Comparative Example 101 | 0.5 | 3 | 3 | 5 | 600 | 5 | 450 | Pearlite | 355 |
| Comparative Example 102 | 30 | 3 | 3 | 5 | 600 | 5 | 450 | Pearlite | 385 |
| Comparative Example 103 | 10 | 0.5 | 3 | 5 | 600 | 5 | 450 | Pearlite | 336 |
| Comparative Example 104 | 10 | 10 | — | — | 600 | 5 | 450 | Bainite + Martensite | 721 |
| Comparative Example 105 | 10 | 3 | 10 | 5 | 600 | 5 | 450 | Pearlite | 367 |
| Comparative Example 106 | 10 | 3 | 3 | 0.5 | 600 | 5 | 450 | Pearlite | 356 |
| Comparative Example 107 | 10 | 3 | 3 | 20 | 600 | 5 | 450 | Pearlite | 704 |

TABLE 2-continued

| | First cooling device | | | | | Second cooling device | | Evaluation | |
|---|---|---|---|---|---|---|---|---|---|
| | Cooling temperature (° C./s) Start of cooling to 10 s | Cooling temperature (° C./s) 10 s to beginning of transformation heat generation | Temperature rising rate (° C./s) During transformation | Cooling rate (° C./s) After end of transformation heat generation | Cooling stop temperature (° C.) | Cooling rate (° C./s) | Cooling stop temperature (° C.) | Surface layer structure | Hardness of inner portion |
| Comparative Example 108 | 10 | 3 | 3 | 5 | 600 | — | — | Pearlite | 345 |
| Comparative Example 109 | 10 | 3 | 3 | 5 | 600 | 5 | 550 | Pearlite | 353 |

As listed in Table 2, it was confirmed that a rail having high hardness from a surface to an inner portion thereof could be produced with high productivity by the method of the present invention.

INDUSTRIAL APPLICABILITY

According to the present invention, a rail manufacturing method and a manufacturing equipment can be provided that enable the whole of the head of a rail from the head surface to the central portion to have high hardness with the surface layer thereof having a pearlite structure without increasing the cooling time.

REFERENCE SIGNS LIST

1 RAIL-MANUFACTURING EQUIPMENT
2 COOLING DEVICE (FIRST COOLING DEVICE)
3 SECOND COOLING DEVICE
4 ROLLING MILL
5 CUTTER
6 COOLING BED
10 RAIL
11 HEAD
111 HEAD-TOP SURFACE
113 HEAD-SIDE SURFACE
115 HEAD-SIDE SURFACE
13 BASE
15 WEB
31, 33 COOLING HEADER (FIRST HEAD COOLING HEADER)
331, 332 COOLING HEADER (SECOND HEAD COOLING HEADER)
391 HEAD THERMOMETER (FIRST HEAD THERMOMETER)
395 HEAD THERMOMETER (SECOND HEAD THERMOMETER)
40 CONTROL SYSTEM
43 CONTROLLER
43*a* TEMPERATURE-MONITORING UNIT
43*b* COOLING-RATE CONTROLLER
44 STORAGE UNIT
50 CONTROLLER
51 TEMPERATURE-MONITORING UNIT
53 COOLING-RATE CONTROLLER

The invention claimed is:

1. A rail-manufacturing equipment that performs forced cooling on at least a head of a rail that is hot after hot-rolled at an austenite region temperature or higher or after heated to the austenite region temperature or higher, the rail-manufacturing equipment comprising:

a head-cooling header configured to jet a cooling medium toward the head of the rail;

a head thermometer configured to measure surface temperature of the head of the rail; and a controller configured to adjust jet of the cooling medium from the head-cooling header, the controller comprising (i) a temperature-monitoring unit configured to monitor measurement results by the head thermometer during the forced cooling, and (ii) a cooling-rate controller configured to:

adjust the jet of the cooling medium from the head-cooling header for 10 seconds from start of the forced cooling so that a cooling rate at a surface of the head becomes 1° C./s to 20° C./s;

determine beginning and end of heat generation during transformation based on a history of the measurement results monitored by the temperature-monitoring unit, and adjust the jet of the cooling medium from the head-cooling header during a period from the beginning to the end of the heat generation during transformation so that the cooling rate at the surface of the head becomes lower than 1° C./s or a temperature-rising rate becomes 5° C./s or lower; and adjust the jet of the cooling medium from the head-cooling header during a period after the end of the heat generation during transformation until temperature at the surface of the head becomes 450° C. or lower so that the cooling rate at the surface of the head becomes 1° C./s to 20° C./s.

2. A rail-manufacturing equipment that performs forced cooling on at least a head of a rail that is hot after hot-rolled at an austenite region temperature or higher or after heated to the austenite region temperature or higher, the rail-manufacturing equipment comprising:

a first cooling device including a first head-cooling header configured to jet a cooling medium toward the head of the rail and a first head thermometer configured to measure surface temperature of the head of the rail;

a second cooling device including a second head-cooling header configured to jet the cooling medium toward the head of the rail and a second head thermometer configured to measure surface temperature of the head of the rail; and a controller configured to adjust jet of the cooling medium from the first head-cooling header and the second head-cooling header, the controller comprising (i) a temperature-monitoring unit configured to monitor measurement results by the first head thermometer and the second head thermometer during the forced cooling, and (ii) a cooling-rate controller configured to:

adjust the jet of the cooling medium from the first head-cooling header for 10 seconds from start of the forced cooling so that a cooling rate at a surface of the head becomes 1° C./s to 20° C./s;

determine beginning and end of heat generation during transformation based on a history of the measurement results by the first head thermometer monitored by the temperature-monitoring unit, and adjust the jet of the cooling medium from the first head-cooling header during a period from the beginning to the end of the heat generation during transformation so that the cooling rate at the surface of the head becomes lower than 1° C./s or a temperature-rising rate becomes 5° C./s or lower;

adjust the jet of the cooling medium from the first head-cooling header during a period after the end of the heat generation during transformation until temperature inside the head of the rail becomes 550° C. to 650° C. so that the cooling rate at the surface of the head becomes 1° C./s to 20° C./s;

instruct the rail to be conveyed to the second cooling device after the temperature inside the head of the rail becomes 550° C. to 650° C.; and adjust the jet of the cooling medium from the second cooling header during a period until temperature at the surface of the head of the rail becomes 450° C. or lower toward the rail forcedly cooled in the first cooling device so that the cooling rate at the surface of the head of the rail becomes 2° C./s to 20° C./s.

3. The rail-manufacturing equipment according to claim 2, wherein the second cooling device is configured to perform the forced cooling in a period until the rail forcedly cooled in the first cooling device is conveyed to a cooling bed.

4. The rail-manufacturing equipment according claim 2, wherein the cooling medium is air or mist in the first cooling device, and the cooling medium is mist or water in the second cooling device.

5. The rail-manufacturing equipment according to claim 3, wherein the cooling medium is air or mist in the first cooling device, and the cooling medium is mist or water in the second cooling device.

* * * * *